US007571681B2

(12) United States Patent
Haughey

(10) Patent No.: US 7,571,681 B2
(45) Date of Patent: Aug. 11, 2009

(54) APPARATUS AND METHOD OF RAILROAD TIE REPLACEMENT

(76) Inventor: Ruston A. Haughey, 7152 Fairway Bend Cir., Sarasota, FL (US) 34243-3603

( * ) Notice: Subject to any disclaimer, the term of this patent is extended or adjusted under 35 U.S.C. 154(b) by 210 days.

(21) Appl. No.: 11/738,247

(22) Filed: Apr. 20, 2007

(65) Prior Publication Data

US 2007/0245921 A1 Oct. 25, 2007

Related U.S. Application Data

(60) Provisional application No. 60/793,538, filed on Apr. 20, 2006.

(51) Int. Cl.
*E01B 29/06* (2006.01)
*E01B 29/05* (2006.01)

(52) U.S. Cl. ..... 104/9; 104/2

(58) Field of Classification Search ..... 104/2, 104/6, 7.1, 9

See application file for complete search history.

(56) References Cited

U.S. PATENT DOCUMENTS 3,698,324 A * 10/1972 Peppin et al. ..... 104/9
3,780,664 A * 12/1973 Holley ..... 104/9
4,862,806 A * 9/1989 Theurer et al. ..... 104/7.2
5,119,723 A * 6/1992 Lovitt, Jr. ..... 104/7.1
5,197,389 A * 3/1993 Glomski et al. ..... 104/9
6,112,670 A * 9/2000 Miller et al. ..... 104/9
6,158,353 A * 12/2000 Theurer ..... 104/9
6,591,755 B2 * 7/2003 Theurer et al. ..... 104/2
6,698,358 B2 * 3/2004 Theurer et al. ..... 104/2
6,792,870 B2 * 9/2004 Theurer et al. ..... 104/9
2002/0121216 A1 * 9/2002 Theurer et al. ..... 104/9
2004/0045472 A1 * 3/2004 Therurer et al. ..... 104/2
2007/0245921 A1 * 10/2007 Haughey ..... 104/2

* cited by examiner

*Primary Examiner*—S. Joseph Morano
*Assistant Examiner*—Jason C Smith
(74) *Attorney, Agent, or Firm*—Gifford, Krass, Sprinkle, Anderson & Citkowski, P.C.

(57) ABSTRACT

Disclosed is a method and apparatus for the simultaneous removal of an old railroad tie that is part of an existing railroad tie with a new railroad tie. The apparatus includes a first railroad car that places a new tie adjacent to the existing railroad track, a second railroad car which picks up and removes an old railroad tie after it has been replaced with the new railroad tie, and a third railroad car located between the first car and second car which has a hydraulic actuator that uses the new tie to simultaneously push out the old tie from under the railroad track and place into position the new tie. The first car has a conveyor that removes a new tie from the first car and places it in a location that is end-to-end adjacent to the old tie. The third car, using the hydraulic actuator takes the new tie and uses it to push the old tie out from under the railroad track and simultaneously place the new tie in proper position. The third car also includes a railroad track lifting frame which can lift the railroad track underneath the third car a slight amount.

13 Claims, 6 Drawing Sheets

APPARATUS AND METHOD OF RAILROAD TIE REPLACEMENT

CROSS-REFERENCE TO RELATED APPLICATIONS

This application claims priority to U.S. provisional patent application Ser. No. 60/793,538, filed Apr. 20, 2006, which is incorporated herein by reference.

FIELD OF THE INVENTION

This invention relates to an apparatus and method of exchanging old railroad ties with new ties and more particularly to use the existing railroad track to guide cars supporting the apparatus for delivering new ties and collecting old ties in a continuous operation.

BACKGROUND OF THE INVENTION

There is a need to periodically replace railroad track ties in order to maintain the railroad tracks in safe operating condition. In the past, tie replacement has been accomplished by a multiplicity of separate pieces of equipment to perform such tasks as removing spikes from the ties to facilitate removing the old tie, subsequently collecting the old tie, delivering new ties, positioning the new ties under the existing track and various other machines for the different aspects of constructing a railroad track.

Attempts have been made to perform the necessary operations of tie replacement with an integrated single assembly of equipment, which can be moved on the existing railroad track as a unit. However, there is still a need for an integrated single assembly of equipment that is operable to replace railroad ties while moving on the existing railroad track as a unit.

SUMMARY OF THE INVENTION

Disclosed is a method and apparatus for the simultaneous removal of an old railroad tie that is part of an existing railroad track with a new railroad tie. The apparatus includes a first railroad car that places a new tie adjacent to the existing railroad track, a second railroad car which picks up and removes an old railroad tie after it has been replaced with the new railroad tie, and a third railroad car located between the first car and second car which has a hydraulic actuator that uses the new tie to simultaneously push out the old tie from under the railroad track and place into position the new tie. The first car has a conveyor that removes the new tie from the first car and places it in a location that is end-to-end adjacent to the old tie to be replaced. The third car then uses the hydraulic actuator to take the new tie and push the old tie out from under the railroad track and simultaneously place the new tie in the old tie's previous position. The third car also includes a railroad track lifting frame which can lift the railroad track underneath the third car a slight amount.

In an embodiment of the present invention, the first car has a conveyor that removes a plurality of new ties from the first car and places each one of the new ties end-to-end adjacent to an old tie to be replaced. In this embodiment, the third car has a plurality of hydraulic actuators which are fixedly attached to an actuator track and are operable to take the new ties and use them to push the old ties out from under the railroad track as the car moves/travels down the railroad track. The second car of this embodiment also has a conveyor that is operable to pick up and remove the old ties that are adjacent to the railroad track and place them onto the second car.

DETAILED DESCRIPTION OF THE PREFERRED EMBODIMENTS

The present invention comprises an apparatus for the simultaneous removal of an old railroad tie that is part of an existing railroad track with a new railroad tie, wherein the new tie is used to push the old tie out from under the existing railroad track. As such, the present invention has utility as an apparatus for repairing railroad tracks in an efficient and safe manner.

The apparatus of the present invention can be a three railroad car assembly wherein a first car places at least one new railroad tie onto a region adjacent to the existing railroad track and a second railroad car picks up and removes an old railroad tie after being replaced with the new tie. A third railroad car, which is located between the first car and the second car, uses a hydraulic actuator to take the new tie and push the old tie out from under the existing railroad track while simultaneously placing the new tie in proper position under the track.

Figure 1:
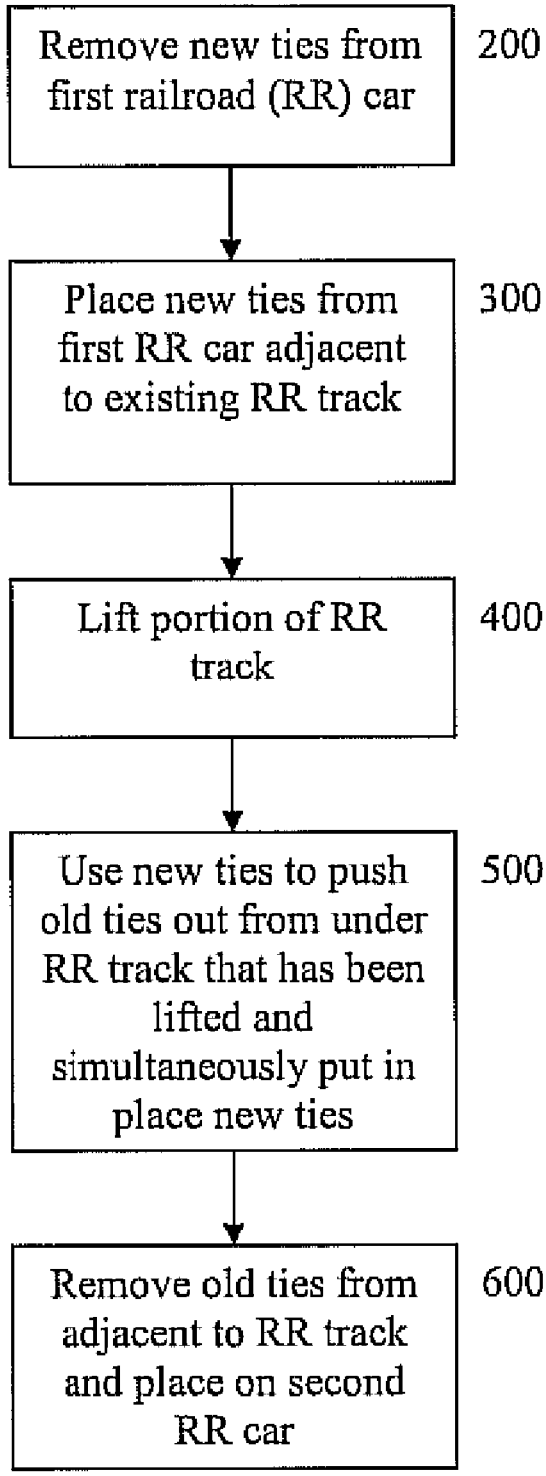
FIG. 1 is a flowchart illustrating a method of the present invention.

Referring now to FIG. 1, there is shown a flowchart illustrating a method of the present invention. In this method, new railroad ties are removed from a leading first railroad car at step 200 and placed end-to-end adjacent to old railroad ties of an existing railroad track at step 300. Next, at step 400 a portion of the existing railroad track is raised and/or lifted and the new ties are used to push the old ties, that are presently in place under the railroad track, out from under the track and simultaneously put the new ties in the old ties'previous location under the track at step 500. Finally, at step 600 the old ties are removed from their location adjacent the railroad track and placed onto a trailing second car.

Referring to the FIGS. 2-5, the apparatus for replacing old ties with new ties is incorporated in at least three railroad cars 12, 14 and 16. The purpose of the car 16 is to collect old ties 18 after they have been displaced from the railroad bed and the purpose of the car 12 is to transport and deliver new ties designated 20 that are to be used to replace the old ties 18 which are removed. As viewed in the drawings, the direction of motion of the cars during the tie replacement operation is from right to left in all of the views except for FIG. 7 wherein the direction of motion is from bottom to top as indicated by the arrow.

The car 14 is disposed between the cars 12 and 16 and acts to manipulate and deliver the new ties 20 to the correct position under a railroad track 5 and to remove the old ties 18. Such replacement of the old ties 18 with the new ties 20 is accomplished by an arrangement of hydraulic actuators 22.

Figure 2:
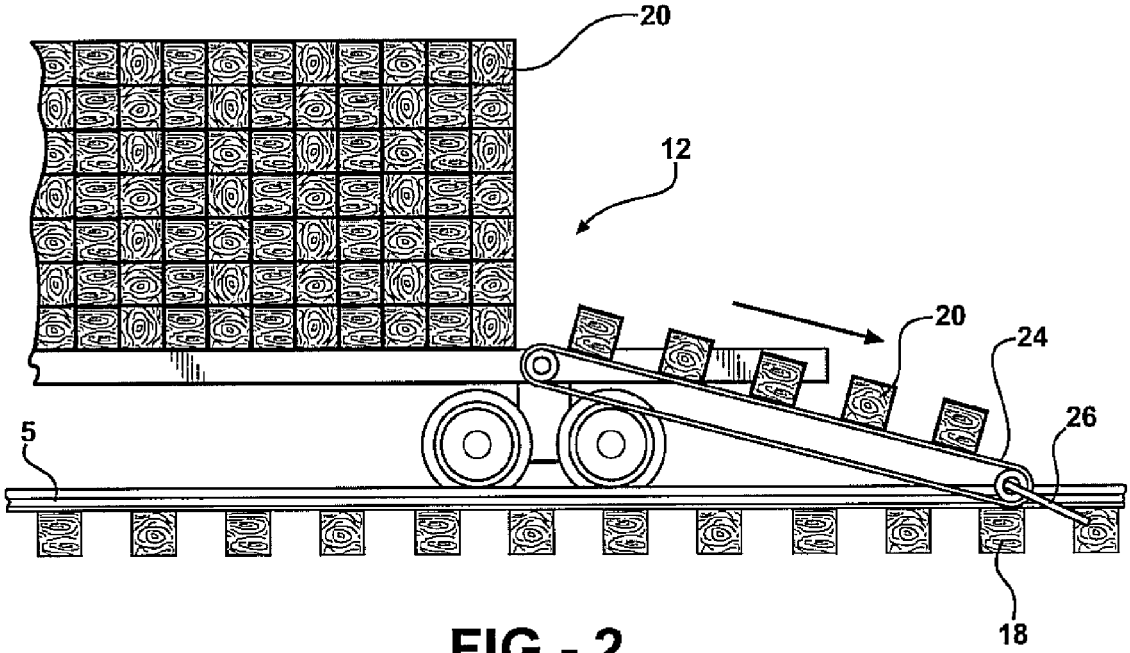
FIG. 2 is an illustration of a portion of a first car of an embodiment of the present invention.

The car 12, shown in FIG. 2, is used to store and to deliver new ties 20 to one side of the existing railroad track 5. The car 12 supports a conveyor 24 disposed to one side of the railroad track 5. The new ties 20 can be loaded either manually or automatically onto the conveyor 24 in generally parallel relationship to each other and aligned in a parallel direction with the old ties 18 in the existing railroad track 5. The conveyor 24 is supported relative to the car 12 so that it can be retracted for fast transport over the railroad track. When new ties 20 are being installed in the existing railroad track 5, the conveyor 24 extends to one side of the car 12 and slopes downwardly from the car bed close to the ground. The lower end of the conveyor 24 is provided with a mechanism 26 by which ties 20 can be released for location in alignment and end-to-end adjacent with old ties 18. Although the mechanism 26 is illustrated as a plate or lever in FIG. 2, it is appreciated that any mechanism afforded for the proper placement of the new ties 20 adjacent to the railroad track 5 and/or end-to-end adjacent to the old ties 18 can be used and is within the scope of the present invention.

Figure 3:
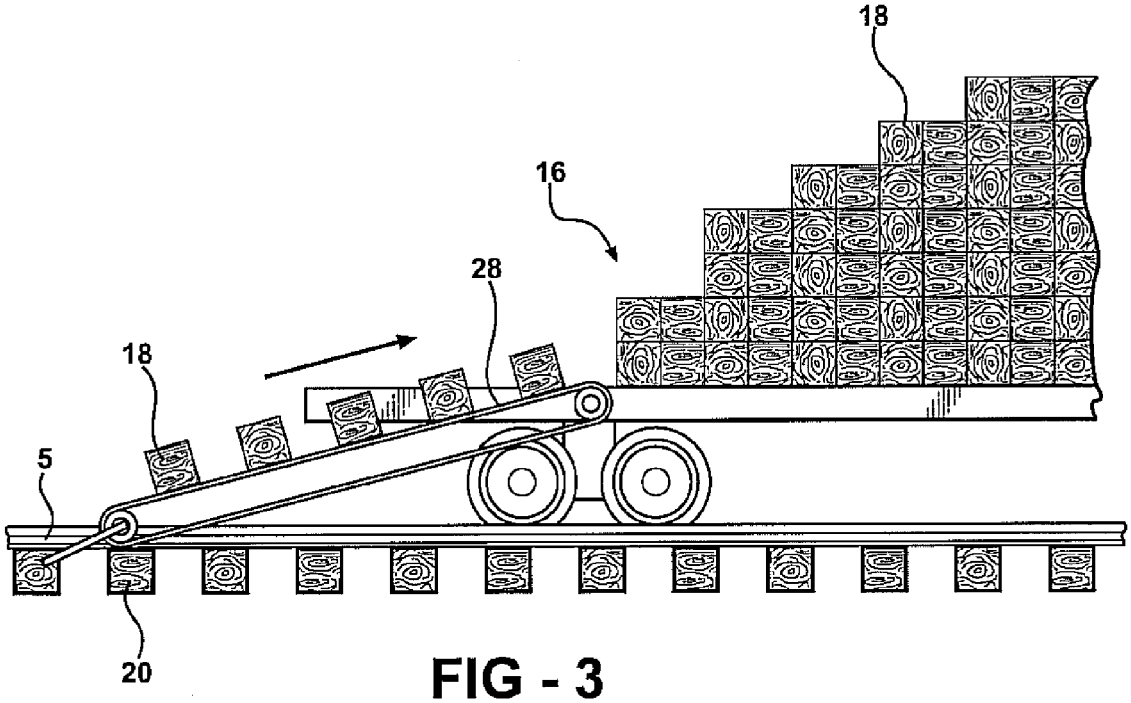
FIG. 3 is an illustration of a portion of a second car.

The purpose of the car 16, shown in FIG. 3, is to collect and transport old ties 18 after they have been removed from beneath the rails of the railroad track 5. For this purpose, the car 16 is provided with a conveyor 28 which has its rear end supported in an elevated position in alignment with the top of the bed of car 16 and its forward end located close to the ground in a position to gather old, loose ties 18, which have been removed from under the railroad tracks 5. The removed ties 18 are moved upwardly by the conveyor 28 and are manually or mechanically manipulated longitudinally to be loaded in a transverse position on the car 16.

The car 14 intermediate the cars 12 and 16 supports the apparatus for manipulating and moving the new ties 20 to replace the old ties 18.

Figure 4:
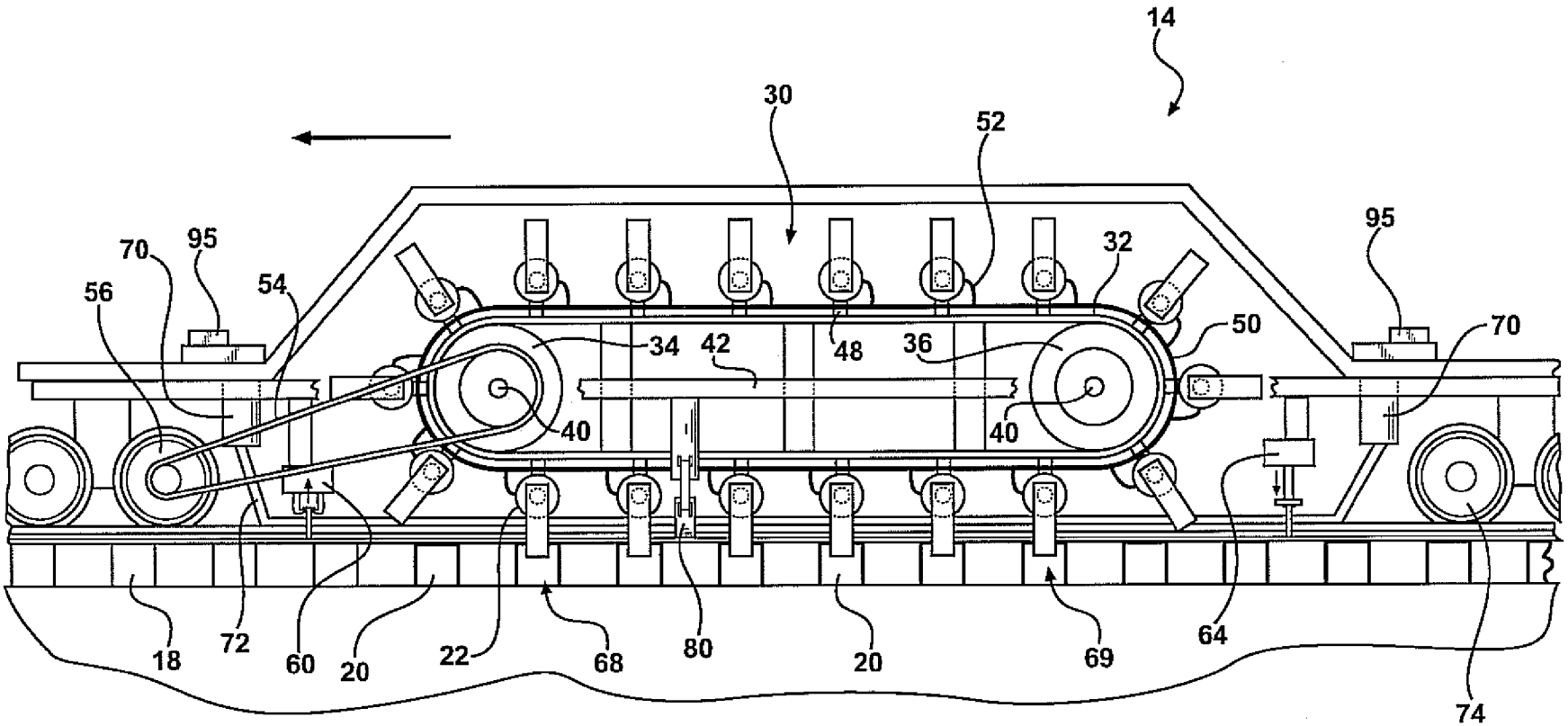
FIG. 4 is a side view of a portion of a third car.
Figure 5:
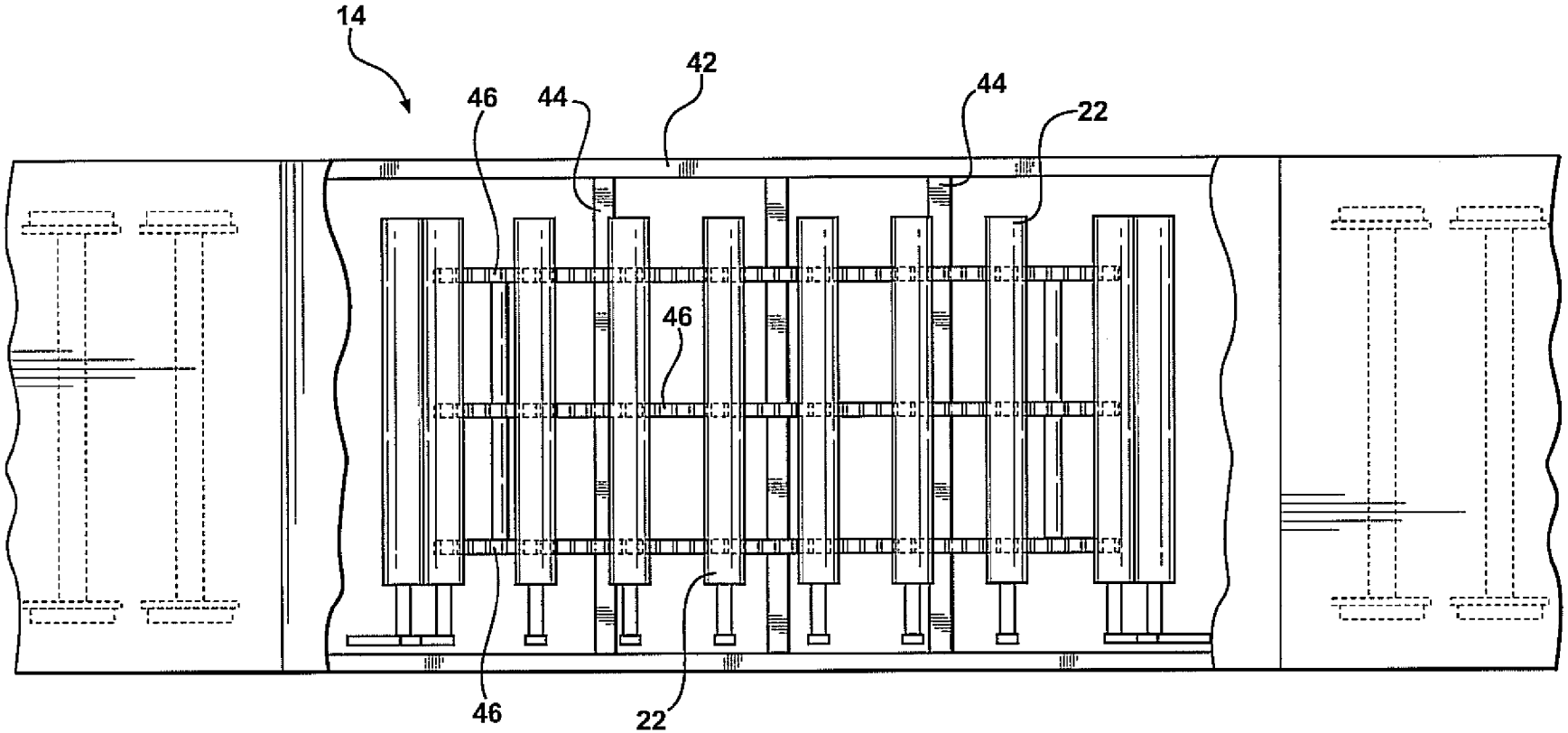
FIG. 5 is a top view of a support frame and a plurality of actuators for the third car.

Apparatus for exchanging ties supported by car 14 and designated generally at 30 includes a continuous, endless chain conveyor 32, also known as an actuator track, having end rollers 34 and 36 supported for rotation at axles 40 attached to a frame 42 as shown in FIGS. 4 and 5. In addition to the axles 40, the frame 42 has several transverse support beams 44 supporting longitudinally extending guide tracks 46 which engage the under side of the top flight of conveyor 32.

The hydraulic actuators 22 extend transversely of car 14 and can be mounted on base members 48. The base members 48 can be supported on toothed rollers (not shown) in engagement with tooth support belts (not shown) extending continuously on the outer surface of the conveyor chain 32 and at opposite sides of the car 14. The independently supported base members 48 can be moved forward and rearwardly a short distance relative to car 14 and relative to the adjacent actuators 22 in response to signals reflecting the spacing of the old ties which are to be removed so that when the new tie 20 is finally delivered it is end-to-end adjacent and in linear alignment with its corresponding old tie 18. In the alternative, the base members 48 can be stationary on the conveyor chain 32 and the actuators 22 can be moved forward and rearwardly a short distance relative to car 14 in response to signals reflecting the spacing of the old ties which are to be removed so that when the new tie 20 is finally delivered it is end-to-end adjacent and in linear alignment with its corresponding old tie 18.

The car 14 also supports the hydraulic system, which delivers hydraulic fluid under pressure and exhausts hydraulic fluid from each of the hydraulic actuators 22 by means of a hydraulic delivery system depicted diagrammatically at 52.

The conveyor chain 32 is driven in timed relationship with the motion of the car 14 over the track through means of a drive depicted diagrammatically at 54 between end roller 34 and one of the track engaging wheels 56 of the car 14.

The car 14 also is equipped with apparatus 60 for removing spikes and plates holding the rails of the track to the ties and for collecting the removed hardware. The apparatus 60 can be any apparatus known to those skilled in the art for removing spikes and plates. In one instance, the apparatus 60 is mechanically operated and fixedly attached to car 14. After removal of spikes and plates for a given old tie 18 has been performed, each of the rails of the track 5 at this location are raised slightly to facilitate movement of the old and new ties 18 and 20. In addition, the car 14 is provided with mechanism for attaching the rail to the new tie as designated at 64 in FIG. 4.

The car 14 can include a railroad track lifting frame 70 which includes a pair of longitudinally extending rail frames 72 associated with each of the rails of the railroad track 5 and supported to extend between from wheels 56 and wheels 74 of car 14. Each of the rail frames 72 is provided with a plurality of guides 80 only one of which is illustrated diagrammatically in FIG. 6. It should be understood however, that several such guides 80 are located in spaced relationship on each of the longitudinally extending rail frames 72. In the alternative, the guides 80 can be attached to the frame 42 as illustrated in FIG. 4.

Figure 6:
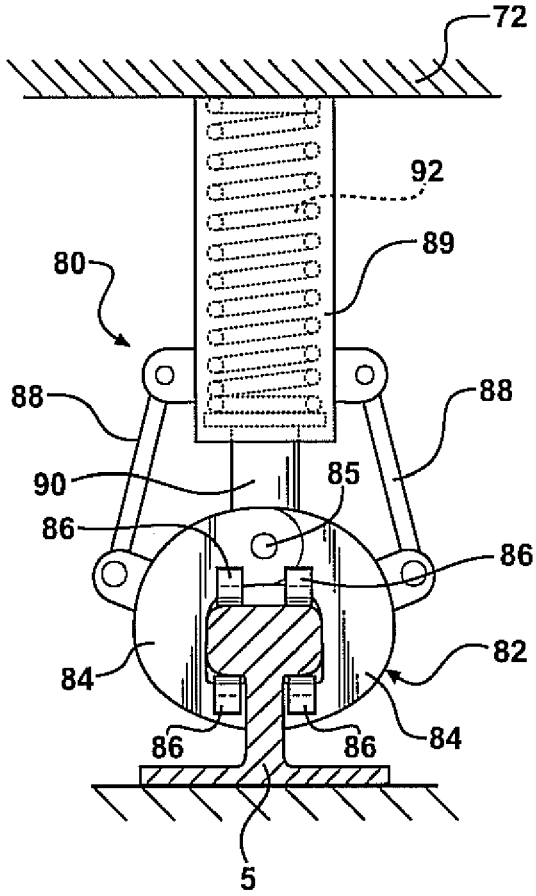
FIG. 6 is an end view of a railroad track with a clamp attached thereto.

Turning to FIG. 6, one example of a guide 80 includes a caliper like clamp 82 having arms 84 hinged at 85. In the closed position of the clamp 82 the arms are provided with rollers 86 engaging the underside of the top web and the top side of the top web of the rail to hold it in a secure position. Each of the caliper arms 84 is supported by a pair of braces 88 each having one end pivoted to one of the caliper arms 84 and the other end to a spring box 89 rigidly mounted on one of the rail frames 72 or in the alternative to the frame 42. An actuating rod 90 is supported at the bottom end of the spring box 89 and is urged downwardly by a spring 92. When the car 14 is positioned on the railroad tracks 5 to begin operation, the caliper clamps 82 are in an open position. All of the guides 80 are actuated by causing the actuating rod 90 of each guide 80 to push upwardly against the spring 92 and close the clamp 82 to engage the associated rail. After the caliper clamps 82 are engaged with the associated rail, provision can be made for inserting a lock pin (not shown) to hold the actuating rod 90 in a fixed position and the clamp 82 in firm sliding engagement with the associated rail.

Provision is made for raising the rails slightly to facilitate removal of the old ties 18 and replacement with new ties 20 by making the rail member 72 adjustable vertically relative to the railroad bed. For this purpose the ends of the rail frame 72 are provided with a jack mechanism indicated at 95. Adjustment of the mechanism 95 causes the associated end of the rail frame 72 to be raised so that as the car 14 moves down the track the rail frames 72 with their associated guides 80 tend to raise the track slightly to afford clearance for the exchange of the old ties 18 with new ties 20. In the alternative, the frame 42 can be provided with the jack mechanism 95 that affords for lifting of a railroad track attached to the clamp 82, assuming the guide 80 is attached to the frame 42.

The guides 80 remain clamped during all tie replacement operations and when the operation is to be terminated all of the guides 80 can be released by removing the locking pins, if pins are used. The locking pins can be inserted and/or removed manually or mechanically.

Figure 7:
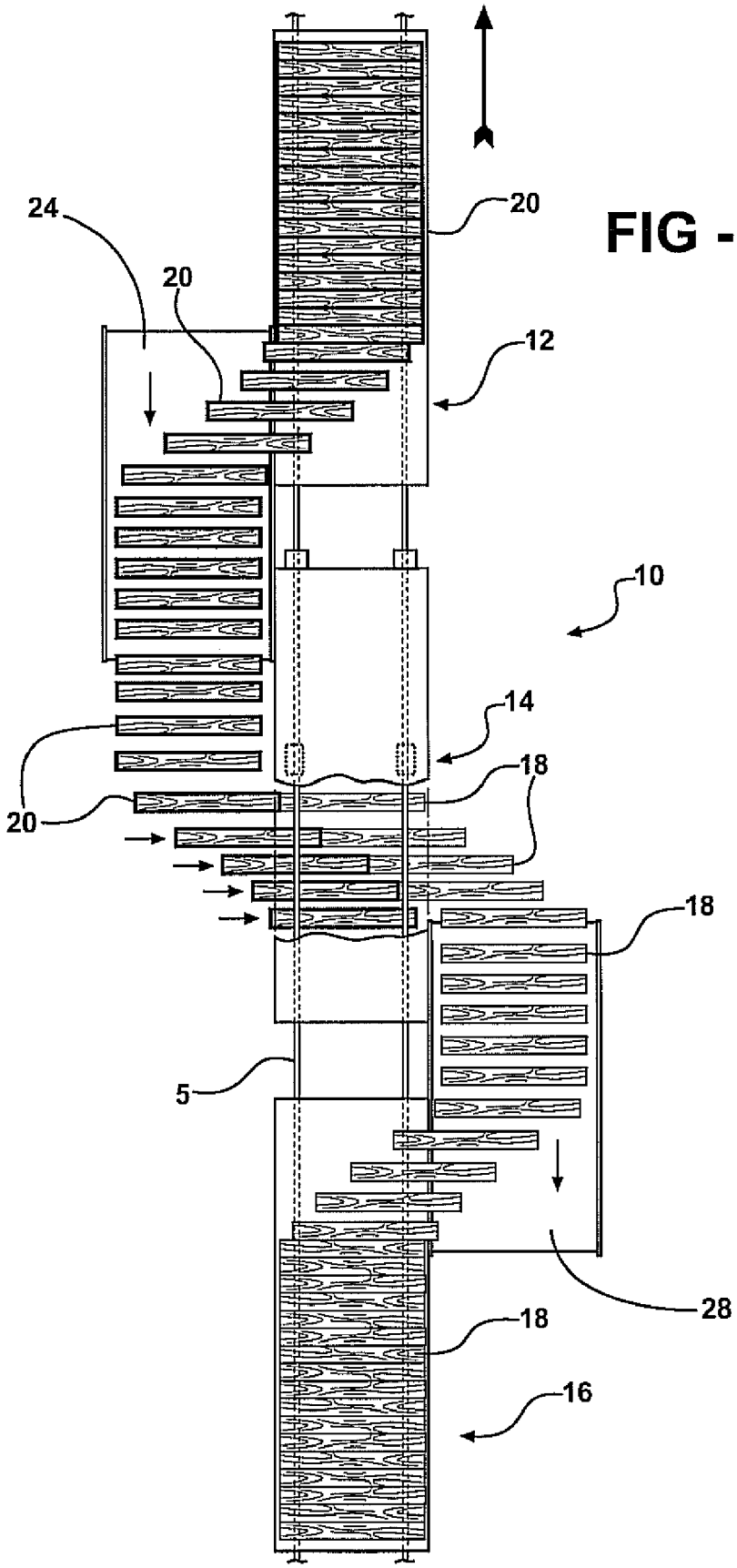
FIG. 7 is a top view of the three cars of the present invention as old railroad ties are replaced with new railroad ties.

Turning to FIG. 7, a top view of the apparatus for an embodiment of the present invention is shown to illustrate the operation of replacing old ties 18 with new ties 20. As shown in this figure, the rail car 12 unloads new railroad ties 20 using conveyor 24 and places the ties 20 adjacent to the railroad track 5 and into end-to-end adjacent alignment with the old railroad ties 18 currently in use as part of the railroad track 5. After railroad car 12 places the new ties 20 in their appropriate position, the railroad car 14 with the associated hydraulic actuators 22 takes the new ties 20 and pushes upon the old ties 18, thereby forcing the ties 18 to be removed from out under the railroad track 5.

The hydraulic actuators 22 uses the old ties 1S to push upon the new ties 20 using any means known to those skilled in the art, illustratively including a clamp to grasp the new tie 20, a plate or lever to exert a pulling force upon the new tie 20 and combinations thereof. Simultaneously, the new ties 20 are placed in their proper position. After the old ties 18 have been removed from under the railroad track 5, the railroad car 16 and conveyor 28 affords for removal of the old ties 18 from adjacent to the railroad track 5 and placement onto the car 16 for proper disposal.

Although the apparatus and method thus far described has been in terms of replacing old wooden ties with new wooden ties, it is contemplated that the new ties can be of a new synthetic or manufactured construction. For example, Primix Corporation of Atwood, Ind., manufactures a tie, which is a composite of structural metal members, concrete and is incased in rubber. Such ties have the advantage of having substantially uniform dimensions and weight, as well as characteristics for supporting rails. Also, it is contemplated that conventional spikes and plates may be supplanted by a mechanism incorporated in the manufactured tie which responds to the weight of the track being placed in position on the tie to clamp or trap the lower web of the rail without the need for tie attachment mechanism for conventional spikes and plates.

Figure 8:
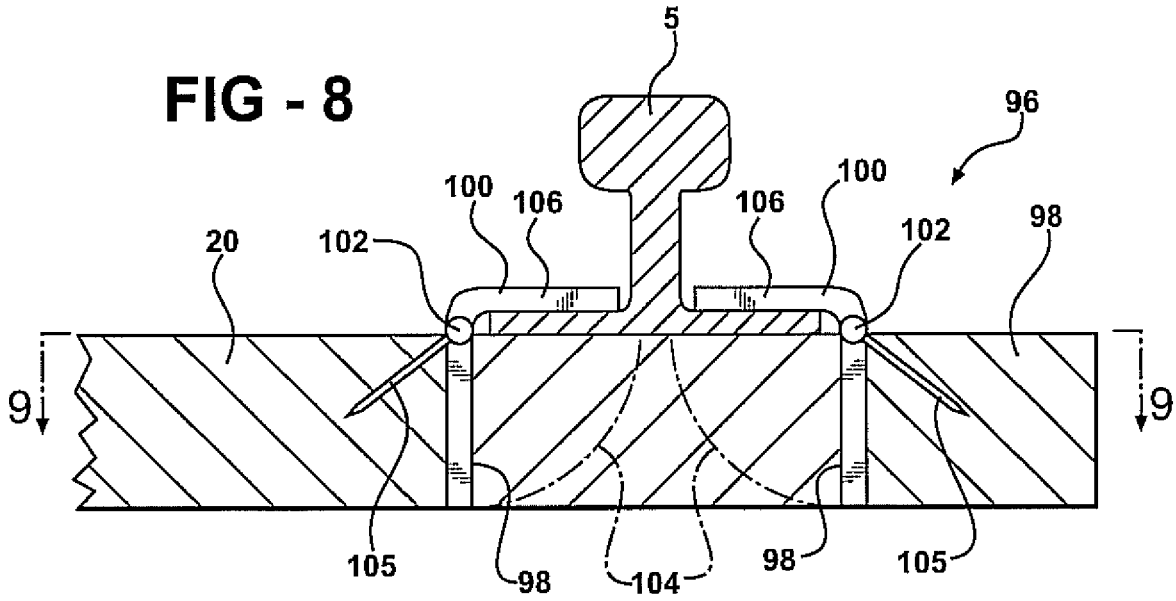
FIG. 8 is an end view of a railroad track with attachment clamps.

An example of a tie attachment mechanism which might be incorporated in a manufactured tie is designated generally at 96 in FIG. 8. The mechanism 96 is purported relative to a recess 98 one of which is formed at each end of the tie 20. A pair of generally L-shaped clamping elements 100 are pivoted on hinge pins 102 and are cast in fixed positions at opposite ends of the opening 98. In an initial position, the clamps 100 are pivoted approximately 90 degrees so that their longer leg lies horizontally in the plane of the top of the tie 20. A separate plug element 105 positioned on the horizontally positioned long legs of the L-shaped clamp 100 so that when the rail is forced downwardly on the plug 105, the clamp 100 swings as indicated by the dash lines at 104 showing the path of movement of the ends of the L-shaped clamps 100. The plug 105 forces the short legs 106 of the clamps 100 to engage the upper surfaces at opposite sides of the longitudinal rail of the railroad track to hold it in a fixed and permanent position.

In replacing ties, the cars are moved on an exiting railroad track from right to left as shown in the figures. Movement of cars causes the mechanism 60 at the forward end of car 14 to pull the existing spikes and plates holding the rail of the track 5 to the old tie 18. At the same time the rails are lifted slightly above the old tie 18 by the guide mechanisms 80 on the rail frames 72 which have been adjusted to an elevated position to give clearance for lateral movement of the old and the new ties.

The apparatus 10 is under the control of a computer system which uses a sensor to identify the width and spacing of the old ties 18 and uses the information to position new ties in precise longitudinal alignment with the old tie it is to replace. This is accomplished by computer-controlled operation of the tie release mechanism indicated at 26 in FIG. 2.

The conveyor chain 32 supporting the hydraulic actuators 22 moves upon movement of the car so that the movement of the actuators 22 relative to the railroad track is stationary. As viewed in FIG. 4, the actuators are moving relative to the supporting car 14 in a counter clockwise direction. At a location designated by arrow 68, the actuator 22 engages the new tie 20 forcing its end into abutment with the existing old tie 18. Thereafter further actuation of the actuator 22 to withdraw its rod causes the new tie 20 to push the old tie 18. During the time the actuator 22 indicated at the position arrow 68 reaches the position indicated by arrow 69 the old tie has been completely displaced from below the rails and the new tie has been substituted. At the position indicated by mechanism 64 in FIG. 4 the rail is refastened to the new tie 20 by spikes or by mechanism in the new tie 20 for clamping the rail to the tie. Such a clamping arrangement is actuated in response to the weight of the car 14 and/or car 16 which pushes the rail into contact with the tie.

As the cars progress down the track, the conveyor 28 associated with the car 16 scoops up the old ties 18 which have been displaced to one side of the track and conveys them up the inclined conveyor 28. At the end of the conveyor 28 the ties 18 can be manipulated either manually or mechanically to move them laterally onto the car 16 for transport away from the railroad track 5. Such removed ties can be converted to charcoal.

In the event that all of the ties 18 are not to be replaced but only selected ties, location data relative to the specified ties must be furnished to the computer system. Similarly, if every other tie or every third tie is to be replaced rather than all of the ties, the appropriate information is entered into the computer central system relative to the selected ties, relative to spacing and the placement of new ties at the appropriate location together with the operation of the appropriate hydraulic actuator 22 to displace the old tie 18 with the new tie 20. In all of these operations it is possible for the train cars 12, 14 and 16 to move continuously on an existing railroad track.

The foregoing drawings, discussion and description are illustrative of specific embodiments of the present invention, but they are not meant to be limitations upon the practice thereof. Numerous modifications and variations of the invention will be readily apparent to those of skill in the art in view of the teachings presented herein. It is the following claims, including all equivalents, which define the scope of the claims.

I claim:

1. An apparatus for simultaneous removal of an old railroad tie that is part of an existing railroad track with a new railroad tie comprising:

a first railroad car movable along said existing railroad track and operable to place a new tie onto a region adjacent the existing railroad track and end-to-end adjacent to an existing railroad track tie as the first railroad car moves along said existing track;

a second railroad car and a third railroad car, said third railroad car and said second railroad car being joined together and said third railroad car being joined with said first railroad car whereby said railroad cars are movable together along said existing rack;

said third car being movable with said first railroad car and being operable to lift the railroad track thereunder and remove the old tie from the existing railroad track and replace it with a new tie placed by the first railroad car as said first railroad car and said third railroad car are moving along said existing track;

said second railroad car movable along said existing track with said first railroad car and said third railroad car and operable while moving to pick up an old tie that has been replaced by a new tie by said third car.

2. The apparatus of claim 1, wherein said first car has a first conveyor operable to move the new tie from said first car to a location adjacent to the existing railroad track.

3. The apparatus of claim 1, wherein said second car has a second conveyor operable to remove the old tie from a region adjacent to an existing railroad track.

4. The apparatus of claim 1, wherein said third car has a hydraulic actuator operable to take the new tie and push the old tie out from under the existing railroad track.

5. The apparatus of claim 4, wherein said hydraulic actuator is fixedly attached to an actuator track, said actuator track supported and moved by at least one end roller and operable to move said hydraulic actuator along said actuator track.

6. The apparatus of claim 5, wherein said hydraulic actuator is fixedly attached to a base member, said base member supported by a toothed roller engaged with a tooth support belt located on and engaged with an outer surface of said actuator track.

7. The apparatus of claim 6, wherein said tooth support belt extends continuously on said outer surface of said hydraulic track.

8. The apparatus of claim 1, wherein said third car has a lifting frame operable to lift a portion of a rail of the existing railroad track located below said third car.

9. The apparatus of claim 8, wherein said lifting frame has two longitudinal extending rail frames, each of said rail frames extending from a front railroad car wheel to a rear railroad car wheel of said third car operable to lift one rail of the existing railroad track.

10. The apparatus of claim 9, wherein each of said rail frames has a guide, said guide operable to attach each of said rail frames to one rail of the existing railroad track.

11. The apparatus of claim 10, wherein said guide has a clamp with hinged arms, said clamp with hinged arms operable to engage a rail of a railroad track.

12. The apparatus of claim 11, wherein said clamp has an actuator rod.

13. An apparatus for the continuous removal of a plurality of old railroad ties that are part of an existing railroad track with new railroad ties comprising:

a first railroad car movable along said existing railroad track and having a first car conveyor, said first car conveyor operable to remove a plurality of new railroad ties from said first car and place said ties sequentially end-to-end adjacent to a plurality of old railroad ties to be replaced as said first car is moving along said track;

a second railroad car movable along said track with said first car and having a second car conveyor, said second car conveyor operable to remove said plurality of old ties from a position adjacent an existing railroad track after being replaced with a plurality of said new ties while said second car is moving along said existing track;

a third railroad car movable with said first and second cars along said track between said first car and said third second car having a railroad track lifting frame and a plurality of hydraulic actuators;

said railroad track lifting frame operable to lift a portion of the existing railroad track that is located directly below said third car as said third car moves along said track;

said plurality of hydraulic actuators fixedly attached to an actuator track, said actuators on said actuator track operable to attach to the plurality of new ties located end-to-end adjacent to the plurality of old ties that are part of the existing railroad track and sequentially and simultaneously push the plurality of new railroad ties under the existing railroad track while pushing out the plurality of old railroad ties out from under the existing railroad track.

* * * * *